US007982415B2

(12) United States Patent
Kimura

(10) Patent No.: US 7,982,415 B2
(45) Date of Patent: Jul. 19, 2011

(54) DISCHARGE LAMP LIGHTING APPARATUS

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 405 days.

(21) Appl. No.: 12/273,106

(22) Filed: Nov. 18, 2008

(65) Prior Publication Data

US 2009/0128049 A1 May 21, 2009

(30) Foreign Application Priority Data

Nov. 19, 2007 (JP) ..... 2007-299356

(51) Int. Cl.
*H05B 31/30* (2006.01)

(52) U.S. Cl. ..... 315/360; 363/22; 363/49; 315/279; 315/300; 315/302

(58) Field of Classification Search ..... 315/279, 315/360, 362, 300, 302
See application file for complete search history.

(56) References Cited

U.S. PATENT DOCUMENTS

2004/0240234 A1* 12/2004 Toda et al. ..... 363/22

FOREIGN PATENT DOCUMENTS

JP 2004-166446 6/2004
JP 2007-179920 7/2007

OTHER PUBLICATIONS

U.S. Appl. No. 12/357,685, filed Jan. 22, 2009, Kimura.

* cited by examiner

*Primary Examiner* — Jacob Y Choi
*Assistant Examiner* — Henry Luong
(74) *Attorney, Agent, or Firm* — Oblon, Spivak, McClelland, Maier & Neustadt, L.L.P.

(57) ABSTRACT

A discharge lamp lighting apparatus includes a switch circuit for DC/AC converting, a discharge lamp connected to a secondary winding of a transformer, a current detector detecting an AC output current of the discharge lamp, an error amplifier outputting an error signal to a detected current, a control circuit generating control signals that turn on/off the switching elements in such a way as to control the AC output current at a predetermined value, and a time division signal generator generating a time division signal at the start of an ON/OFF operation of the switching elements, wherein the time division signal delays a change in a burst dimming signal or has a predetermined inclination on the burst dimming signal. The error amplifier changes the error signal according to the time division signal from the time division signal generator.

5 Claims, 5 Drawing Sheets

DISCHARGE LAMP LIGHTING APPARATUS

BACKGROUND OF THE INVENTION

1. Field of the Invention

The present invention relates to a discharge lamp lighting apparatus for lighting a discharge lamp used for, for example, a liquid crystal display unit.

2. Description of the Related Art

There is a discharge lamp lighting apparatus that employs a burst dimming pulse signal to control the brightness of a discharge lamp to a desired level. This apparatus starts and stops an ON/OFF operation of switching elements such as p-type and n-type FETs according to the burst dimming pulse signal, thereby controlling the brightness of the discharge lamp.

There is a discharge lamp lighting apparatus of this type that conducts a soft start operation during a burst dimming operation. An example of this type of discharge lamp lighting apparatus is described in Japanese Unexamined Patent Application Publication No. 2004-166446. The apparatus of this related art employs a transformer having a primary winding connected to a semiconductor switch circuit and a secondary winding connected to a load. The related art carries out PWM control on each switch in the semiconductor switch circuit, to realize an inverter that passes a constant current to the load. The related art also controls an intermittent operation during the burst dimming operation.

Namely, in each OFF interval in the burst dimming operation, the related art zeroes an error signal used for the PWM control. In addition, at the start and end of an ON or OFF interval of the burst dimming operation, the related art gradually increases or decreases the error signal used for the PWM control by charging and discharging a capacitor of a feedback circuit, to slowly start or end the PWM control, which works to provide a constant current.

SUMMARY OF THE INVENTION

The discharge lamp lighting apparatus of the above-mentioned patent document, however, commonly employs the capacitor (136 in FIG. 3 of the patent document) for conducting phase compensation for an error amplifier and for determining an inclination of the soft start operation.

Due to this, making the inclination of the soft start operation gentler by the capacitor at the start of an ON interval of the burst dimming operation results in delaying response of a feedback control loop with respect to a change in a current passed through the load. As a result, a sudden load change or a sudden input change may cause a sudden brightness change of the discharge lamp, and in some cases, may break the switching elements or the transformer.

On the other hand, speeding up the response of the feedback control loop with respect to a change in a current passed through the load with the use of the capacitor results in making the inclination of the soft start operation steeper at the start of an ON interval of the burst dimming operation, i.e., at the time when the switch circuit starts to carry out an ON/OFF operation according to a burst dimming signal. Such a steep inclination of the soft start operation causes a surge in a current passed to the discharge lamp, to cause noise on a display and deteriorate the reliability of the discharge lamp.

According to the present invention, a discharge lamp lighting apparatus capable of easily realizing a soft start operation at the start of each ON interval in a burst dimming operation can be provided.

According to a first aspect of the present invention, provided is a discharge lamp lighting apparatus including a switch circuit configured to convert a DC voltage of a DC power source into an AC voltage by turning on/off one or more switching elements, a transformer having a primary winding connected to the switch circuit and a secondary winding to output an AC voltage, a discharge lamp connected to the secondary winding of the transformer, a current detector configured to detect an AC output current passed to the discharge lamp, an error amplifier configured to output an error signal representative of an error voltage between a detected value from the current detector and a predetermined reference voltage, a controller configured to generate, based on the error signal from the error amplifier, control signals that turn on/off the switching elements in such that the AC output current is controlled at a predetermined value, and a time division signal generator configured to generate a time division signal at the start of an ON/OFF operation of the switching elements, the time division signal being one of a signal that delays a change in a burst dimming signal and a signal that is formed by superimposing a signal having a predetermined inclination on the burst dimming signal. The error amplifier changes the error signal according to the time division signal from the time division signal generator.

According to a second aspect of the present invention, the time division signal generator includes an inclination determining capacitor configured to determine an inclination of the time division signal, a charger configured to charge the inclination determining capacitor with a predetermined current when the burst dimming signal indicates an output OFF state, and a discharge circuit configured to discharge the inclination determining capacitor with a predetermined current when the burst dimming signal indicates an output ON state. The time division signal is supplied to an inverting input terminal of the error amplifier.

According to a third aspect of the present invention, the time division signal generator includes an inclination determining capacitor configured to determine an inclination of the time division signal, a discharger configured to discharge the inclination determining capacitor with a predetermined current when the burst dimming signal indicates an output OFF state, and a charge circuit configured to charge the inclination determining capacitor with a predetermined current when the burst dimming signal indicates an output ON state. The time division signal is supplied to a non-inverting input terminal of the error amplifier.

According to a fourth aspect of the present invention, the reference voltage is generated by a voltage divider including a plurality of resistors connected in series, an inclination determining capacitor is connected to the voltage divider that generates the reference voltage, and the time division signal generator includes a discharger configured to discharge the inclination determining capacitor when the burst dimming signal indicates an output OFF state.

According to a fifth aspect of the present invention, the controller includes a triangular wave generator and comparators configured to compare a triangular wave signal from the triangular wave generator, the error signal from the error amplifier, and the time division signal from the time division signal generator with one another, and according to the comparison result, turn on/off the switching elements.

DESCRIPTION OF THE PREFERRED EMBODIMENT

Discharge lamp lighting apparatuses according to the embodiments of the present invention will be explained in detail with reference to the drawings.

Each discharge lamp lighting apparatus is characterized in that a burst dimming signal is supplied to a time division signal generator to generate a time division signal, and according to the time division signal, an ON/OFF operation of p-type and n-type FETs Qp1 and Qn1 is started and stopped.

First Embodiment

Figure 1:
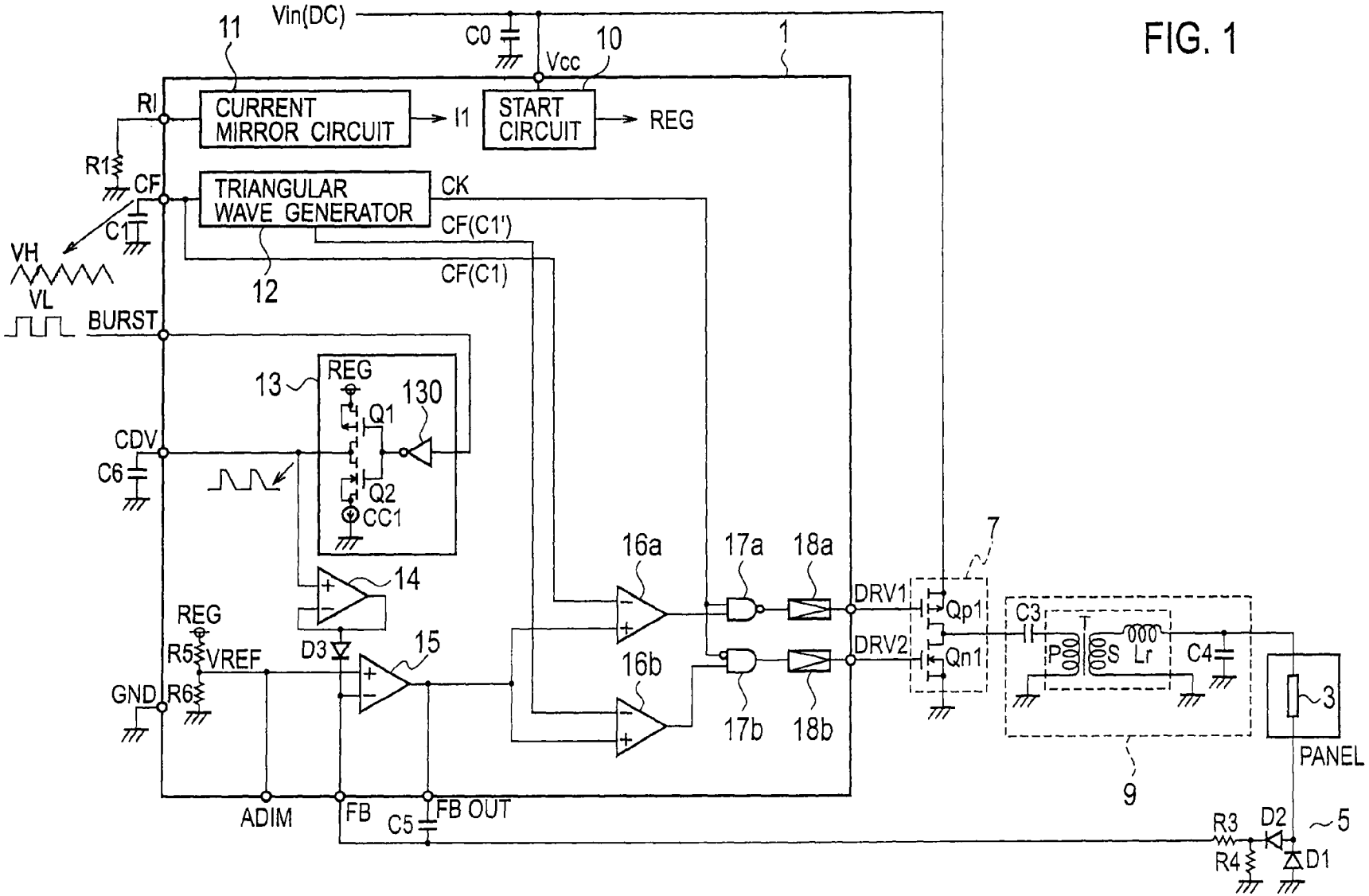
FIG. 1 is a circuit diagram illustrating a discharge lamp lighting apparatus according to a first embodiment of the present invention.

FIG. 1 is a circuit diagram illustrating a discharge lamp lighting apparatus according to the first embodiment. The apparatus of FIG. 1 includes, between a DC power source Vin and the ground, a series circuit including a high-side p-type MOSFET Qp1 (hereinafter referred to as "p-type FET Qp1") and a low-side n-type MOSFET Qn1 (hereinafter referred to as "n-type FET Qn1"). Between a connection point of the p-type and n-type FETs Qp1 and Qn1 and the ground, there is a series circuit including a capacitor C3 and a primary winding P of a transformer T. Ends of a secondary winding S of the transformer T are connected to a capacitor C4. A reactor Lr is a leakage inductance of the transformer T.

A source of the p-type FET Qp1 receives the DC power source Vin and a gate thereof is connected to a terminal DRV1 of a control circuit 1. A gate of the n-type FET Qn1 is connected to a terminal DRV2 of the control circuit 1.

The control circuit 1 includes a start circuit 10, a current mirror circuit 11, a triangular wave generator 12, an inclination generator 13, error amplifiers 14 and 15, PWM comparators 16*a* and 16*b*, a NAND gate 17*a*, a logic gate 17*b* as an AND gate with a positive logic input and a negative logic input, and drivers 18*a* and 18*b*.

The current mirror circuit 11 is connected through a terminal R1 to an end of a constant current determining resistor R1. The triangular wave generator 12 is connected through a terminal CF to an end of a capacitor C1.

Figure 2:
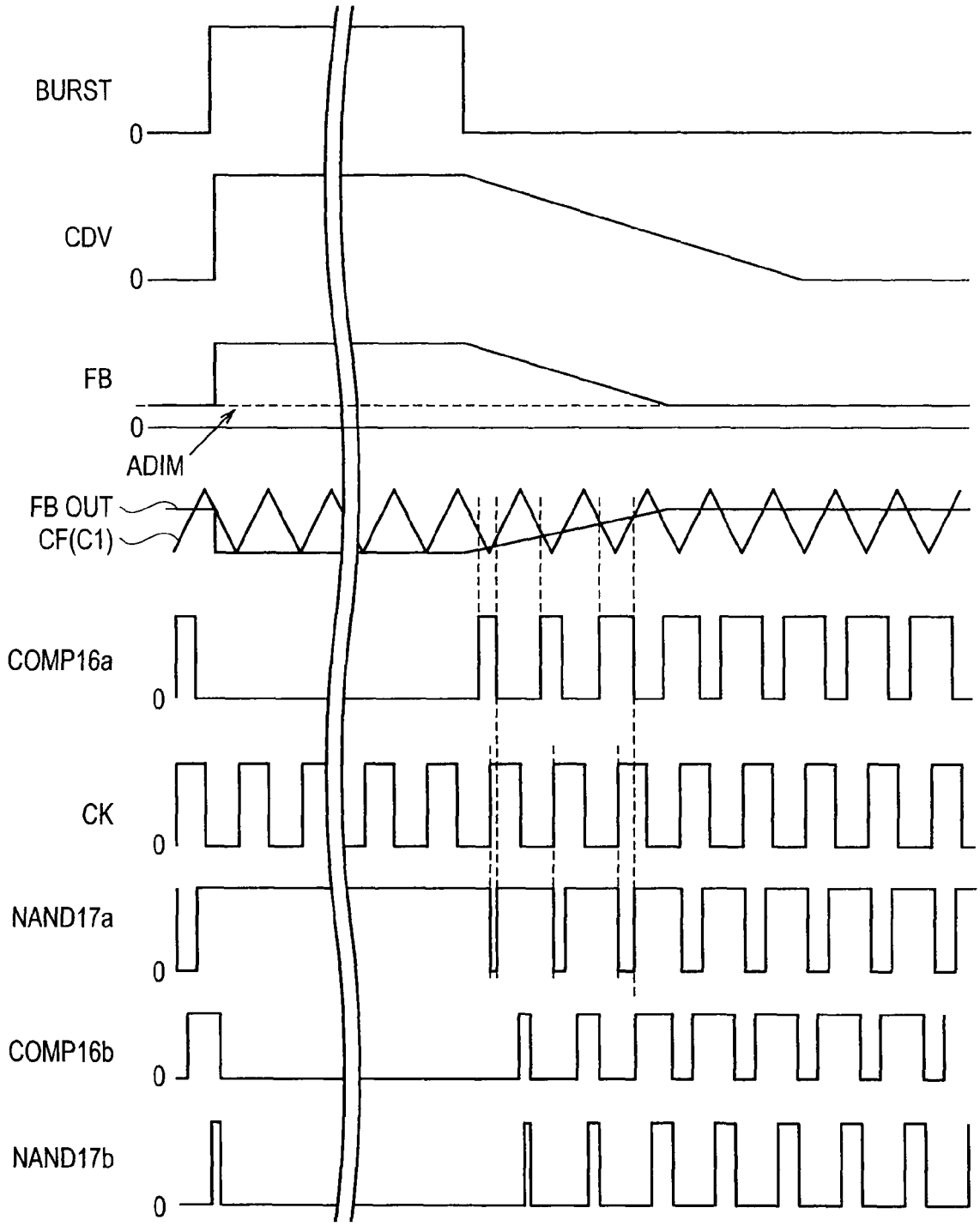
FIG. 2 is a waveform diagram illustrating signals concerning a burst dimming operation carried out in the apparatus of FIG. 1.

The start circuit 10 receives power from the DC power source Vin, generates a predetermined voltage REG, and supplies the voltage REG to internal parts. The current mirror circuit 11 passes a constant current that is optionally determined according to the constant current determining resistor R1. Based on the constant current from the current mirror circuit 11, the triangular wave generator 12 charges and discharges the capacitor C1 to generate an oscillating triangular wave as illustrated in FIG. 2 (the waveform as illustrated in FIG. 2 indicates a charge/discharge voltage of the capacitor C1), as well as a clock CK based on the oscillating triangular wave CF(C1). The clock CK has a voltage pulse waveform that is synchronous with the oscillating triangular wave at the terminal CF and keeps a high level during a rise period of the triangular wave and a low level during a fall period of the triangular wave. The clock CK is sent to the NAND gate 17*a* in positive logic and the logic gate 17*b* in negative logic.

A first end of the secondary winding S of the transformer T is connected to a first electrode of a discharge lamp 3. A second electrode of the discharge lamp 3 is connected to a lamp current detector 5. The reactor Lr is a leakage inductance component of the transformer T. The lamp current detector 5 includes diodes D1 and D2 and a resistor R4, to detect a current passed through the discharge lamp 3 and generate a voltage proportional to the detected current. This voltage is supplied through a resistor R3 and a feedback terminal FB of the control circuit 1 to a negative (−) terminal (inverting input terminal) of the error amplifier 15.

The inclination generator 13 and an inclination determining capacitor C6 form a time division signal circuit. The time division signal circuit receives a burst dimming signal and generates a time division signal when the p-type and n-type FETs Qp1 and Qn1 start an ON/OFF operation. The time division signal is a signal to delay a change in the burst dimming signal, or a signal formed by superimposing a signal having a predetermined inclination on the burst dimming signal. Based on the time division signal, the error amplifier 15 starts and stops an ON/OFF operation of the p-type and n-type FETs Qp1 and Qn1.

The inclination generator 13 includes an inverter 130 to receive the burst dimming signal, p-type and n-type FETs Q1 and Q2 whose gates are connected to an output of the inverter 130, and a constant current source CC1. Between the power source REG and the ground, the p-type and n-type FETs Q1 and Q2 and the constant current source CC1 are connected in series.

A connection point of the p-type and n-type FETs Q1 and Q2 is connected through a terminal CDV to the inclination determining capacitor C6 and is also connected to a positive (+) terminal of the buffer 14 that is a voltage follower. A negative (−) terminal of the buffer 14 is connected to an output terminal thereof and a connection point of the negative and output terminals of the buffer 14 is connected through a diode D3 to the negative terminal of the error amplifier 15.

Between the power source REG and the ground, there is a series circuit including resistors R5 and R6. A connection point of the resistors R5 and R6 is connected to a positive (+) terminal (non-inverting input terminal) of the error amplifier 15. An output terminal of the error amplifier 15 is connected to positive (+) terminals of the PWM comparators 16*a* and 16*b*.

The PWM comparator 16*a* generates a pulse signal that is low when an error voltage FBOUT supplied from the error amplifier 15 to the positive terminal of the PWM comparator 16*a* is equal to or higher than a voltage of the triangular wave signal CF (C1) supplied from the terminal CF to the negative terminal of the PWM comparator 16*a* and is high when the error voltage FBOUT is lower than the voltage of the triangular wave signal CF (C1). The pulse signal generated by the PWM comparator 16*a* is sent to the NAND gate 17*a*.

The PWM comparator 16*b* generates a pulse signal that is high when the error voltage FBOUT supplied from the error amplifier 15 to the positive terminal of the PWM comparator 16*b* is equal to or higher than the voltage of an inverted signal CF (C1') supplied from the triangular wave generator 12 to the negative terminal of the PWM comparator 16*b* and is low when the error voltage FBOUT is lower than the voltage of the inverted signal CF(C1'). The pulse signal generated by the PWM comparator 16*b* is sent to the logic gate 17*b*. Here, the inverted signal CF(C1') is formed by inverting the triangular wave signal CF (C1) around a midpoint potential between an upper limit value VH and a lower limit value VL of the triangular wave signal CF(C1).

The NAND gate 17*a* operates a NAND of the clock CK from the triangular wave generator 12 and the signal from the PWM comparator 16*a* and outputs a first drive signal through the driver 18*a* and terminal DRV1 to the p-type FET Qp1. The logic gate 17*b* operates an AND of an inversion of the clock CK from the triangular wave generator 12 and the signal from the PWM comparator 16*b* and outputs a second drive signal through the driver 18*b* and terminal DRV2 to the n-type FET Qn1.

The first drive signal provided by the PWM comparator 16*a*, NAND gate 17*a*, and driver 18*a* has a pulse width that is shorter than a half period of the triangular wave signal CF(C1) and corresponds to a current passed through the discharge lamp 3. The first drive signal drives the p-type FET Qp1 to pass a current through the discharge lamp 3. The second drive signal provided by the PWM comparator 16*b*, logic gate 17*b*, and driver 18*b* has substantially the same pulse width as the first drive signal and a phase difference of about 180 degrees with respect to the first drive signal, to drive the n-type FET Qn1 and pass a current through the discharge lamp 3 in a direction opposite to the current passed by the first drive signal.

Operation of the first embodiment will be explained with reference to a timing chart illustrated in FIG. 2.

The p- and n-type FETs Qp1 and Qn1 are alternately turned on/off in response to the first and second drive signals, to generate rectangular-wave voltages. The rectangular-wave voltages are applied to the capacitor C3 and the primary winding P of the transformer T. Then, the capacitor C3, the leakage inductance of the transformer T, and the capacitor C4 resonate to apply a sinusoidal-wave voltage to the discharge lamp 3.

The circuit illustrated in FIG. 1 is configured so that resonance of the leakage inductance of the transformer T and the capacitor C4 becomes dominant.

When the output from the transformer T is in a direction to turn on the diode D1, the diode D1 passes a current passed through the discharge lamp 3. When the output from the transformer T is in the opposite direction to turn off the diode D1, the diode D2 turns on to pass a current of the discharge lamp 3 through the resistor R3. The resistor R3 generates a voltage corresponding to the current as a current detected signal. The resistor R4 and a capacitor C5 of a feedback circuit form an integration circuit (smoothing circuit).

The negative terminal of the error amplifier 15 receives through the terminal FB the voltage of the current detected signal from the current detector 5. The positive terminal of the error amplifier 15 receives a voltage VREF provided by dividing the power source REG by the resistors R5 and R6. The error amplifier 15 amplifies an error voltage between these input voltages and outputs an error signal.

The triangular wave generator 12 outputs the clock CK having a predetermined period, the triangular wave signal CF(C1) that gradually rises when the clock CK is high and gradually falls when the clock CK is low, and the inverted triangular wave signal CF(C1') that is an inversion of the triangular wave signal CF(C1). An inclination of the triangular wave signal CF(C1) is determined by the capacitor C1 and a current supplied from the triangular wave generator 12 to the terminal CF.

The error signal from the error amplifier 15 is supplied to the positive terminals of the PWM comparators 16*a* and 16*b*. The negative terminal of the PWM comparator 16*a* receives the triangular wave signal CF(C1) from the triangular wave generator 12. The negative terminal of the PWM comparator 16*b* receives the inverted signal CF(C1') that is an inversion of the triangular wave signal CF(C1). The PWM comparator 16*a* compares the error signal and triangular wave signal with each other and outputs a PWM signal whose pulse width corresponds to the comparison result. The PWM comparator 16*b* compares the error signal and inverted triangular wave signal with each other and outputs a PWM signal whose pulse width corresponds to the comparison result.

The output from the PWM comparator 16*a* is supplied to an input terminal of the NAND gate 17*a*. The other input terminal of the NAND gate 17*a* receives the clock CK from the triangular wave generator 12. When the clock CK is high, the NAND gate 17*a* outputs the signal from the PWM comparator 16*a* as a NAND signal NAND17*a* to drive the p-type FET Qp1 through the driver 18*a*.

The output from the PWM comparator 16*b* is supplied to an input terminal of the logic gate 17*b*. The other input terminal of the logic gate 17*b* receives an inversion of the clock CK from the triangular wave generator 12. When the clock CK is low, the logic gate 17*b* outputs the signal from the PWM comparator 16*b* as a signal NAND 17*b* to drive the n-type FET Qn1 through the driver 18*b*.

As a result, the p-type and n-type FETs Qp1 and Qn1 alternately turn on/off in response to the detected signal from the current detector 5. For example, if a current passed to the discharge lamp 3 increases, the current detected signal provided by the resistor R3 increases to reduce the output from the error amplifier 15.

This results in narrowing the pulse widths of output signals of the p- and n-type FETs Qp1 and Qn1, i.e., shortening ON periods of the p-type and n-type FETs Qp1 and Qn1, thereby reducing energy transmitted to the secondary side of the transformer T and a current passed to the discharge lamp 3. On the other hand, if a current passed through the discharge lamp 3 decreases, the ON periods of the p-type and n-type FETs Qp1 and Qn1 are elongated to increase a current passed through the discharge lamp 3. In this way, a current passing through the discharge lamp 3 is adjusted.

The inverter 130 of the inclination generator 13 inverts a burst dimming signal and outputs an inverted burst dimming signal. If the burst dimming signal is high, the output from the inverter 130 is low to turn on the p-type FET Q1 and off the n-type FET Q2.

As a result, the inclination determining capacitor C6 is rapidly charged to a high level and the buffer 14 provides a high-level output to the negative terminal of the error amplifier 15. Then, the error amplifier 15 maintains a low-level output, and therefore, the PWM comparators 16*a* and 16*b* each provide no pulse. As a result, the p-type and n-type FETs Qp1 and Qn1 stop, and therefore, the discharge lamp 3 is not lighted.

When the burst dimming signal becomes low, the inverter 130 of the inclination generator 13 provides a high-level output to turn off the p-type FET Q1 and on the n-type FET Q2.

As a result, the inclination determining capacitor C6 discharges through the n-type FET Q2 to the constant current source CC1, so that the voltage of the inclination determining capacitor C6 gradually decreases at a predetermined inclination.

At this time, the output from the buffer 14 gradually decreases to gradually increase the output from the error amplifier 15. Then, the PWM comparators 16*a* and 16*b* each output a PWM signal whose width gradually widens to start turning on/off the p-type and n-type FETs Qp1 and Qn with gradually widening ON periods.

When the output from the buffer 14 becomes smaller than a current detected signal from the resistor R3, the diode D3 turns off, and therefore, only the current detected signal is supplied to the negative terminal of the error amplifier 15. As a result, control is conducted to substantially equalize the current detected signal supplied to the negative terminal of the error amplifier 15 with the voltage VREF supplied to the positive terminal thereof, so that a constant current is passed through the discharge lamp 3.

In this way, the time division signal circuit according to the first embodiment generates a time division signal at the start of each ON interval in which the p-type and n-type FETs Qp1 and Qn1 are turned on/off in a burst dimming operation, the time division signal being a signal that delays a change in a burst dimming signal, or a signal that is formed by superimposing a signal having a predetermined inclination on the burst dimming signal. Based on the time division signal, the error amplifier 15 changes an error signal provided by the error amplifier 15. Namely, the error signal is changed according to the time division signal that gradually changes, to easily realize a soft start operation at the start of each ON interval of a burst dimming operation. An amount of change in the soft start operation is determined by an inclination applied to a burst dimming signal, and therefore, is adjustable without sacrificing a response of the error amplifier 15 or a response of an overall control system of the apparatus.

Second Embodiment

Figure 3:
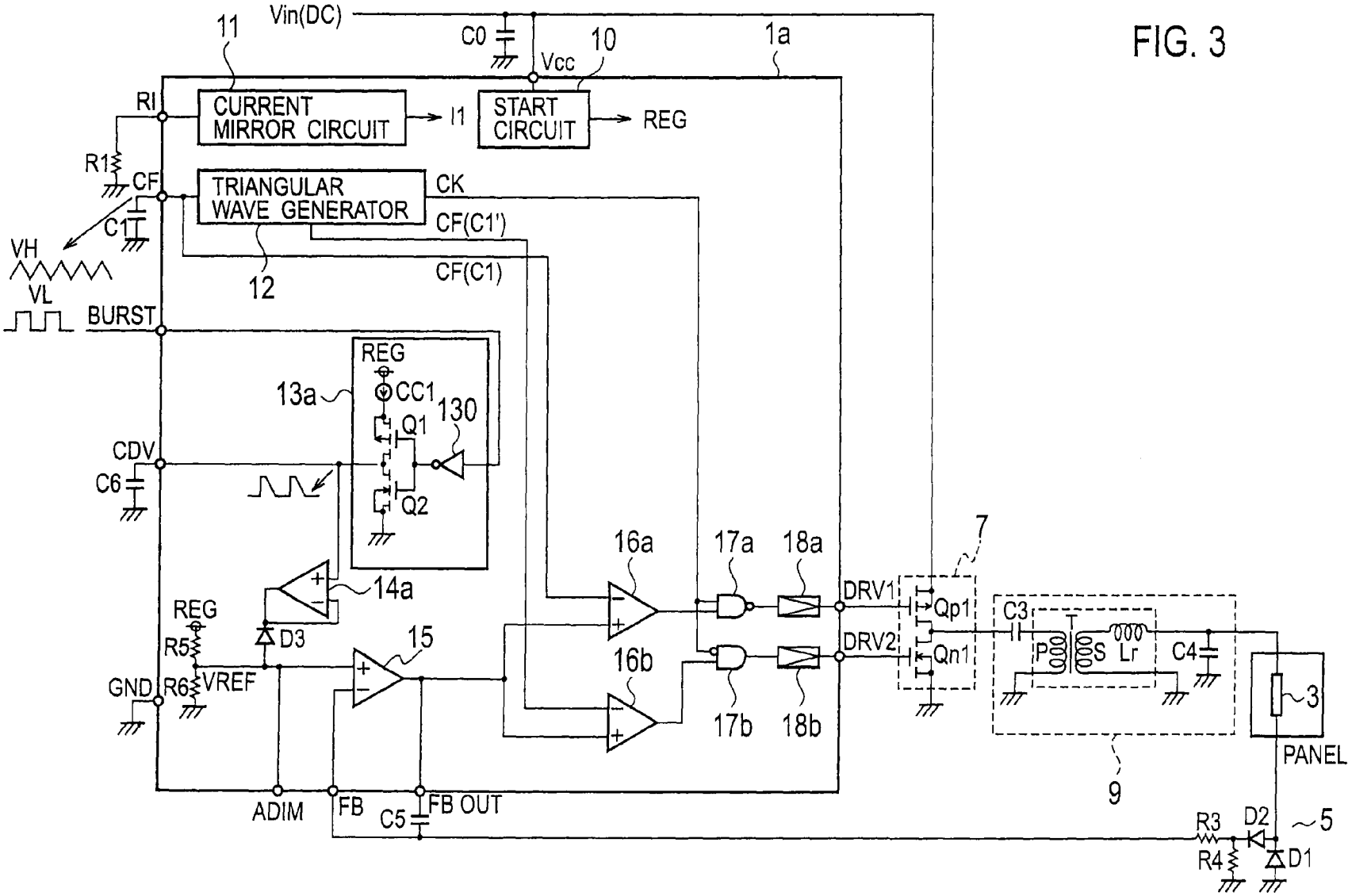
FIG. 3 is a circuit diagram illustrating a discharge lamp lighting apparatus according to a second embodiment of the present invention.

FIG. 3 is a circuit diagram illustrating a discharge lamp lighting apparatus according to the second embodiment of the present invention. The second embodiment employs an inclination generator 13*a* that includes an inverter 130, a p-type FET Q1, an n-type FET Q2, and a constant current source CC1 that is arranged between a power source REG and the p-type FET Q1.

A connection point of the p-type and n-type FETs Q1 and Q2 is connected through a terminal CDV to an inclination determining capacitor C6, and also, is connected to a positive (+) terminal of a buffer 14*a* that is a voltage follower. A negative (−) terminal of the buffer 14*a* and an output terminal thereof are connected to each other. A connection point of the negative and output terminals of the buffer 14*a* is connected through a diode D3 to a positive (+) terminal of an error amplifier 15. The positive terminal of the error amplifier 15 is also connected to a connection point of resistors R5 and R6.

The error amplifier 15 receives, at the positive terminal thereof, a voltage VREF and a time division signal and combines them to carry out a soft start operation at the start of each ON interval of a burst dimming operation. Connection of the diode D3 is opposite to that as illustrated in FIG. 1.

Except the time division signal, operation of the second embodiment is the same as that of the first embodiment illustrated in FIG. 1, and therefore, only the time division signal of the second embodiment will be explained.

When a burst dimming signal is low, the inverter 130 provides a high-level output to turn off the p-type FET Q1 and on the n-type FET Q2. The inclination determining capacitor C6 discharges at once and becomes low, and the buffer 14*a* receives the low-level signal and provides a low-level output to turn on the diode D3 and make the voltage VREF low. As a result, the positive terminal of the error amplifier 15 becomes low to zero a current passed through the discharge lamp 3.

When the burst dimming signal is high, the inverter 130 provides a low-level output to turn on the p-type FET Q1 and off the n-type FET Q2. The constant current source CC1 provides a constant current to charge the inclination determining capacitor C6, to gradually increase the voltage of the capacitor C6. The output from the buffer 14*a* gradually increases to gradually increase the voltage VREF. As a result, the output from the error amplifier 15 gradually increases, and therefore, PWM comparators 16*a* and 16*b* each output a PWM signal whose pulse width gradually widens.

Accordingly, a p-type FET Qp1 and an n-type FET Qn1 each gradually increase an ON period to start an ON/OFF operation and gradually increase a current passed to a discharge lamp 3. When the output from the buffer 14*a* becomes equal to or larger than the voltage VREF, the diode D3 turns off and a control circuit 1*a* controls a current passing through the discharge lamp 3 in such a way as to equalize the voltage of a current detected signal with the voltage VREF.

In this way, the second embodiment operates like the first embodiment, to carry out a soft start operation that gradually increases a current passed through the discharge lamp 3 at the start of each ON interval of a burst dimming operation.

Third Embodiment

Figure 4:
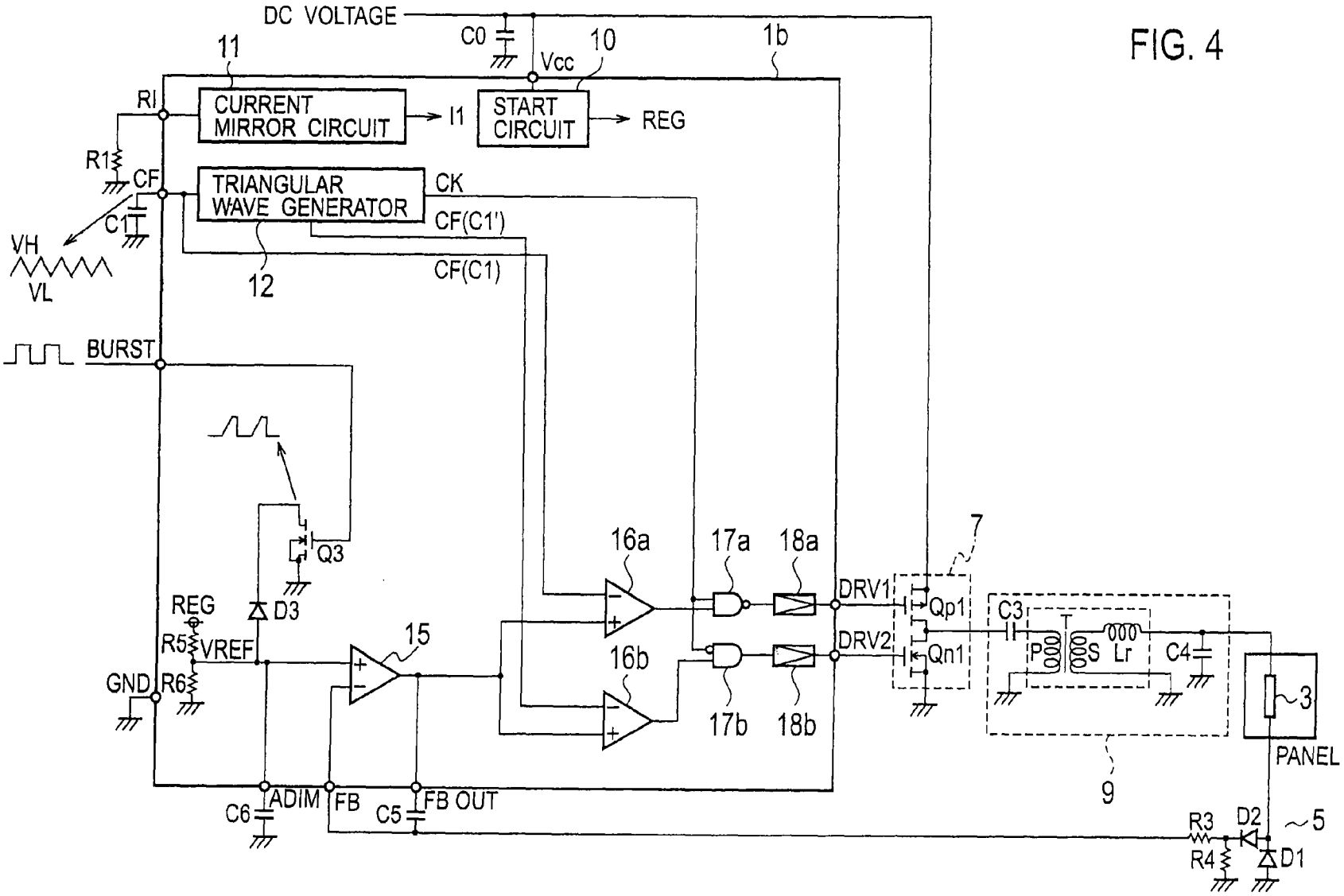
FIG. 4 is a circuit diagram illustrating a discharge lamp lighting apparatus according to a third embodiment of the present invention.

FIG. 4 is a circuit diagram illustrating a discharge lamp lighting apparatus according to the third embodiment of the present invention. The third embodiment of FIG. 4 connects an inclination determining capacitor C6 to an output of a voltage divider (R5, R6) in parallel with the resistor R6. The third embodiment employs an n-type FET Q3 whose gate receives a burst dimming signal and whose drain is connected through a diode D3 to a connection point of the resistors R5 and R6, i.e., an output point of the voltage divider.

When the burst dimming signal is high, the n-type FET Q3 turns on to short-circuit the inclination determining capacitor C6 through the diode D3, so that a positive (+) terminal of an error amplifier 15 instantaneously becomes nearly zero. This makes a negative (−) terminal of the error amplifier 15 low to zero a current passed through a discharge lamp 3.

When the burst dimming signal is low, the n-type FET Q3 turns off to charge the inclination determining capacitor C6 through the resistor R5. This gradually increases a voltage at the positive terminal of the error amplifier 15, to gradually increase an output from the error amplifier 15. As a result, PWM comparators 16*a* and 16*b* each output a PWM signal whose pulse width gradually widens.

Accordingly, a p-type FET Q1 and an n-type FET Q2 each gradually increase an ON period and start an ON/OFF operation, to gradually increase a current passing through the discharge lamp 3. When the voltage at the positive terminal of the error amplifier 15 reaches a voltage VREF, the voltage at the positive terminal of the error amplifier 15 is kept at the voltage VREF and a control circuit 1*b* controls a current passed through the discharge lamp 3 in such a way as to equalize the voltage of a current detected signal with the voltage VREF.

In this way, the third embodiment provides an effect similar to that provided by the first embodiment.

Fourth Embodiment

Figure 5:
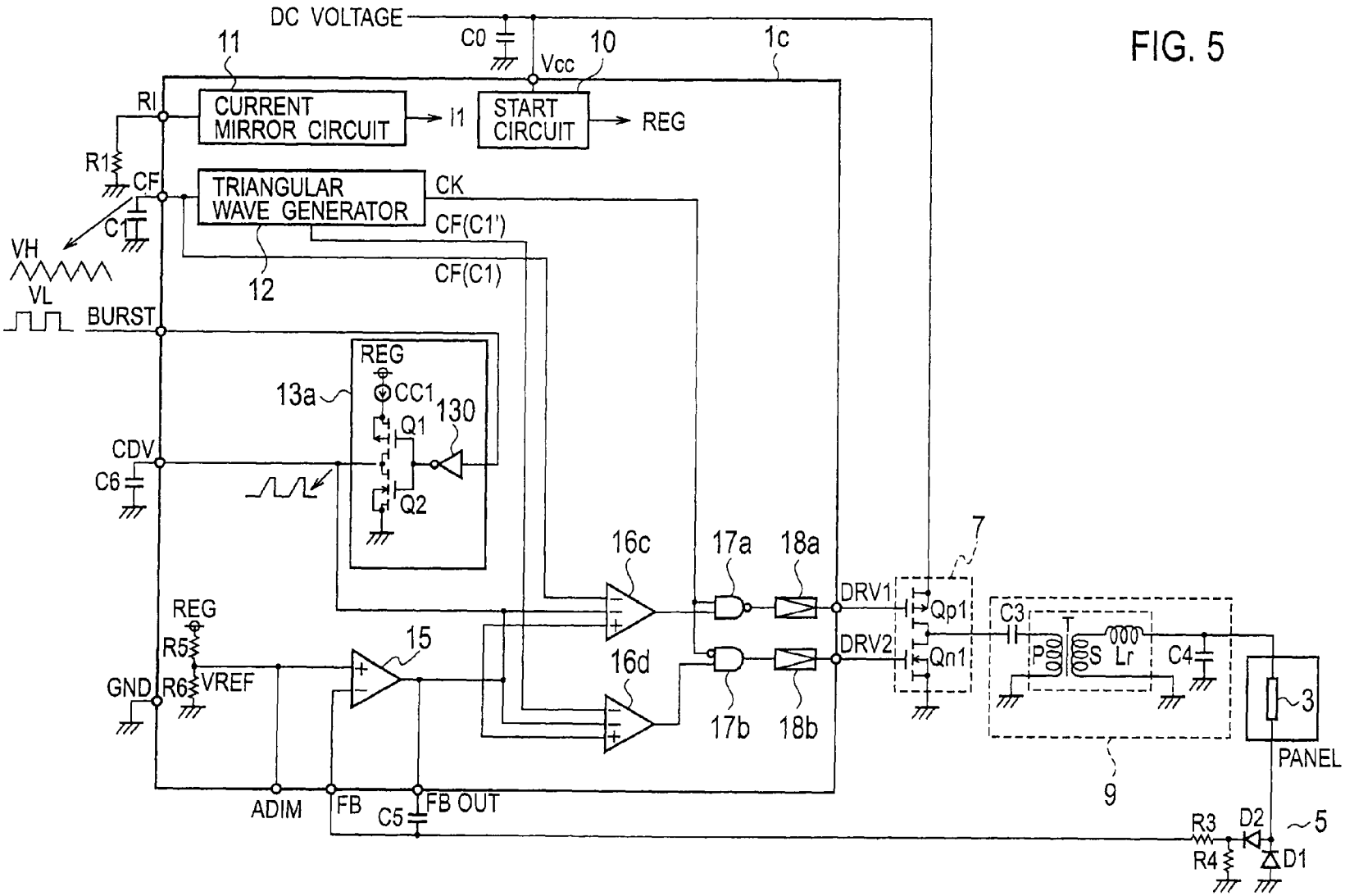
FIG. 5 is a circuit diagram illustrating a discharge lamp lighting apparatus according to a fourth embodiment of the present invention.

FIG. 5 is a circuit diagram illustrating a discharge lamp lighting apparatus according to the fourth embodiment of the present invention. The fourth embodiment employs the time division signal circuit 13*a* of the second embodiment illustrated in FIG. 3 and PWM comparators 16*c* and 16*d*.

The PWM comparator 16*c* compares a triangular wave signal CF(C1) from a triangular wave generator 12, an error signal from an error amplifier 15, and a time division signal from the time division signal circuit 13*a* with one another and generates a PWM signal to carry out an ON/OFF operation of p-type and n-type FETs Qp1 and Qn1.

The PWM comparator 16*d* compares an inverted signal CF(C1') that is an inversion of the triangular wave signal CF(C1) from the triangular wave generator 12, the error signal from the error amplifier 15, and the time division signal from the time division signal circuit 13*a* and generates a PWM signal to carry out the ON/OFF operation of the p-type and n-type FETs Qp1 and Qn1.

When the time division signal is low, the PWM comparators 16*c* and 16*d* provide no output to thereby stop the operation of the p-type and n-type FETs Qp1 and Qn1.

When the time division signal gradually increases, the PWM comparators 16*c* and 16*d* compare the time division signal with the (inverted) triangular wave signal and output PWM signals whose pulse widths gradually widen.

As a result, the p-type and n-type FETs Qp1 and Qn1 repeatedly turn on/off with gradually widening ON periods. If the time division signal exceeds the error signal, the error signal and triangular wave signal are compared with each other to output PWM signals. Based on these PWM signals, a current passing through a discharge lamp 3 is controlled by a control circuit 1*c* at a current as determined by a voltage VREF supplied to the positive terminal of the error amplifier 15.

Each of the first to fourth embodiments explained above employs an inverter that turns on/off the two switching elements Qp1 and Qn1 to resonate the resonant circuit 9 on the secondary side including the leakage inductance of the transformer T and provide an AC output. This configuration does not limit the present invention. For example, the present invention may employ a full-bridge system using four switching elements, or a center-tap system using two switching elements. The resonant capacitor C4 may be arranged on the primary side of the transformer T.

The discharge lamp lighting apparatus according to any one of the first to fourth embodiments employs the time division signal circuit that is capable of applying an inclination to a time division signal independently of a response of the feedback control loop that controls a current passing through the discharge lamp 3 at a constant value. Without being limited by the inclination applied to a soft start operation to be carried out at the start of each ON interval of a burst dimming operation, the apparatus sufficiently quickens a response of the feedback control loop, to speedily control an output current when, for example, a sudden load change occurs. At the start of each ON interval of a burst dimming operation, the apparatus carries out the soft start operation that gradually increases power supply to a load.

The present invention, therefore, can properly carry out a burst dimming operation for a notebook personal computer that needs a quick response for a control loop to cope with a sudden input change, or for an inverter that provides an AC output without a DC-DC converter by conducting a switching operation on an AC-ripple-involving output from a passive-type power factor correction circuit (PFC).

In summary, the discharge lamp lighting apparatus according to the present invention includes the time division signal circuit that generates a time division signal at the start of an ON/OFF operation of switching elements, the time division signal being a signal to delay a change in a burst dimming signal or a signal formed by superimposing a signal having a predetermined inclination on the burst dimming signal. The apparatus also includes the error amplifier that gradually changes an error signal according to the time division signal. As a result, the apparatus can easily achieve a soft start operation at the start of each ON interval of a burst dimming operation. An amount of change in the soft start operation is determined by an inclination applied to the burst dimming signal, and therefore, is adjustable without sacrificing a response of the error amplifier or a response of an overall control system of the apparatus.

The discharge lamp lighting apparatus according to the present invention is structurally simple because it supplies the time division signal to an input terminal of the error amplifier.

The effect of the first embodiment of the present invention is also achievable by supplying the time division signal to a comparator.

This application claims benefit of priority under 35USC §119 to Japanese Patent Application No. 2007-299356, filed on Nov. 19, 2007, the entire content of which is incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge lamp lighting apparatus comprising:

a switch circuit configured to convert a DC voltage of a DC power source into an AC voltage by turning on/off one or more switching elements;

a transformer having a primary winding connected to the switch circuit and a secondary winding to output an AC voltage;

a discharge lamp connected to the secondary winding of the transformer;

a current detector configured to detect an AC output current passing through the discharge lamp;

an error amplifier configured to output an error signal representative of an error voltage between a detected value of the current detector and a predetermined reference voltage;

a controller configured to generate, based on the error signal of the error amplifier, control signals that turn on/off the switching elements to control the AC output current at a predetermined value; and a time division signal generator configured to generate a time division signal at the start of an ON/OFF operation of the switching elements, the time division signal being one of a signal that delays a change in a burst dimming signal and a signal that is formed by superimposing a signal having a predetermined inclination on the burst dimming signal, wherein the error amplifier changes the error signal according to the time division signal of the time division signal generator.

2. The apparatus of claim 1, wherein the time division signal generator comprises:

an inclination determining capacitor configured to determine an inclination of the time division signal;

a charger configured to charge the inclination determining capacitor with a predetermined current when the burst dimming signal indicates an output OFF state; and a discharger configured to discharge the inclination determining capacitor with a predetermined current when the burst dimming signal indicates an output ON state, wherein the time division signal is supplied to an inverting input terminal of the error amplifier.

3. The apparatus of claim 1, wherein the time division signal generator comprises:

an inclination determining capacitor configured to determine an inclination of the time division signal;

a discharger configured to discharge the inclination determining capacitor with a predetermined current when the burst dimming signal indicates an output OFF state; and a charger configured to charge the inclination determining capacitor with a predetermined current when the burst dimming signal indicates an output ON state, wherein the time division signal is supplied to a non-inverting input terminal of the error amplifier.

4. The apparatus of claim 1, wherein:

the reference voltage is generated by a voltage divider including a plurality of resistors connected in series;

an inclination determining capacitor is connected to the voltage divider; and the time division signal generator includes a discharger configured to discharge the inclination determining capacitor when the burst dimming signal indicates an output OFF state.

5. The apparatus of claim 1, wherein the controller includes:

a triangular wave generator; and comparators configured to compare a triangular wave signal from the triangular wave generator, the error signal from the error amplifier, and the time division signal from the time division signal generator with one another, and according to the comparison result, turn on/off the switching elements.

* * * * *